US005979008A

United States Patent [19]

Gordon

[11] Patent Number: 5,979,008

[45] Date of Patent: Nov. 9, 1999

[54] GOLF CLUB CLEANING APPARATUS

[75] Inventor: Robert Jeffery Gordon, Elmhurst, Ill.

[73] Assignee: Gordon Enterprises, Ltd., Elmhurst, Ill.

[21] Appl. No.: 09/004,658

[22] Filed: Jan. 8, 1998

[51] Int. Cl.[6] ..... A43B 5/00

[52] U.S. Cl. ..... 15/227; 15/210.1

[58] Field of Search ..... 15/209.1, 210.1, 15/227; 36/127, 132, 136

[56] References Cited

U.S. PATENT DOCUMENTS

| | | | |
|---|---|---|---|
| 4,122,577 | 10/1978 | Catania | 15/210.1 |
| 4,403,366 | 9/1983 | Lucke | 15/209.1 |
| 4,823,426 | 4/1989 | Bragga | 15/227 |
| 4,912,800 | 4/1990 | Zeltner | 15/210.1 |
| 5,433,436 | 7/1995 | Hoyt et al. | 36/132 |
| 5,809,669 | 9/1998 | Hage et al. | 15/227 |

*Primary Examiner*—Terrence R. Till
*Attorney, Agent, or Firm*—Knechtel, Demeur & Samlan

[57] ABSTRACT

A golf club cleaning apparatus is provided. According to the invention, there is a face plate made of a semirigid material having at least one clip affixed to its back side. A washable and reusable face piece is affixed to the front side of the face plate. Indicia may be displayed on the front of the face piece. In use, a golfer will attach the face plate to golfing footwear, clothing, or other equipment and use the face piece for cleaning golf clubs. In one embodiment, the face piece, when soiled, can be removed, washed, and replaced on the face piece for reuse.

12 Claims, 2 Drawing Sheets

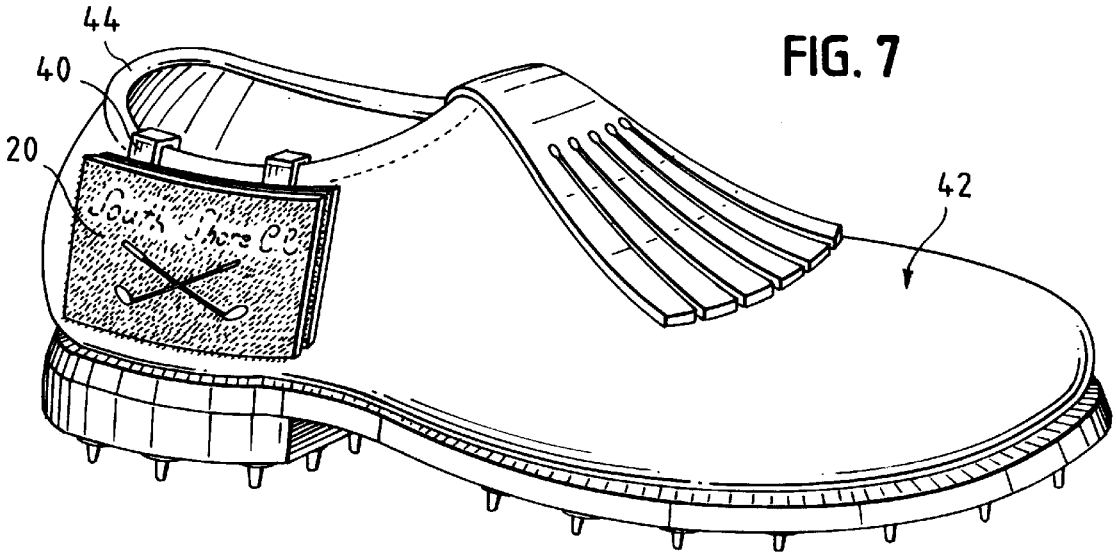
FIG. 7
FIG. 8
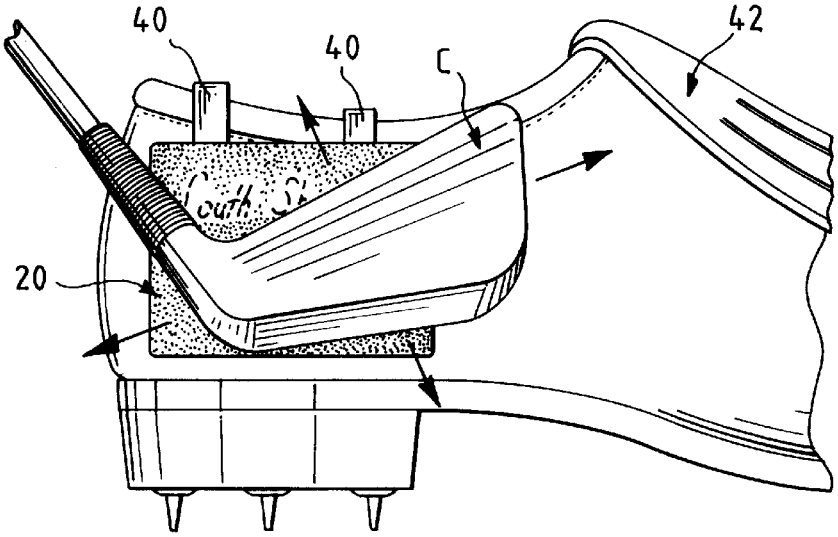
FIG. 6
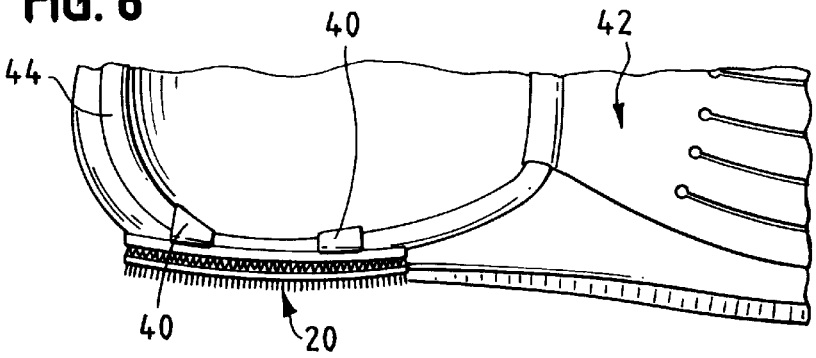

GOLF CLUB CLEANING APPARATUS

I. TECHNICAL FIELD

The present invention relates to cleaning devices for golf clubs and, more particularly, to a cleaning device for golf clubs which is attachable to footwear. The device has a base containing fastening means which clip onto footwear, the base having a face piece attached to it, the face piece is used for cleaning golf clubs.

II. BACKGROUND OF THE INVENTION AND PRIOR ART

It is well known that having clean golf club heads is critical to accurate shot taking and placement, and, thus is at least indirectly related to improving one's golf score. While playing golf it is not unusual, indeed even expected, that golf clubs will become coated with debris. This occurs when a golf club head comes in contact with either grass, dirt, or other debris on a golf course.

Over the years golfers have resorted to various means of cleaning to keep golf clubs clean during a round of golf. Included in these methods of cleaning are attaching a towel to a golf bag, using course provided cleaning mechanisms found at tee off boxes, and rubbing a club against the grass, or clothing. Using a towel attached to a bag or golf course supplied cleaning mechanisms is effective in cleaning a golf club but it is often inconvenient. For instance, it is a common occurrence that a player will not be near his or her bag when taking a shot, thus the towel attached to the golf bag is of no use to the player. Likewise, golf course supplied cleaning mechanisms are generally found near tee off boxes, thus, they are only convenient for use when a player is at a tee off box.

Rubbing a club against the grass is ineffective in maintaining golf clubs inasmuch as the grass itself may cause grass or other debris to accumulate on the club head.

Finally, golfers frequently use clothing, such as a pant leg, for cleaning clubs. While this may be an effective golf club cleaning method, this system obviously leads to excessive wear and tear to and unnecessary soiling of clothing.

There is a need, therefore, for a portable, convenient, and easy to use method for cleaning golf clubs. These needs are met in the present invention.

III. OBJECTS OF THE INVENTION

It is an object of the invention to provide a portable golf club cleaning apparatus.

It is an another object of the invention to provide a golf club head cleaning apparatus which is attachable to golfing footwear or alternatively to other clothing or articles of equipment.

It is yet another object of the invention to provide such a golf club cleaning apparatus which contains a removable, washable and reusable face piece.

It is another object of the present invention to provide a golf club head cleaning apparatus having a face piece onto which words, phrases, logos, or other indicia can be displayed.

VI. SUMMARY OF THE INVENTION

A portable golf club head cleaning apparatus is provided. According to the invention, the device has a solid face plate having at least one clip extending in a downward direction affixed to the back of the face plate. The face plate can be flat or convex when viewed from the front. Attached to the outer surface of the face plate that surface being opposite to the clip, is a reusable attachment means, such as Velcro®.

A face piece is affixed to the front of the face plate. The face piece is of the same perimeter size as that of the face plate. The front of the face piece can be solid in color, patterned, or have words, phrases, logos, or any other indicia displayed on it. The face piece may be molded directly to, or permanently or removably affixed to the face plate.

The device is then attached to the side of footwear or, alternatively, to other clothing, or a piece of equipment. When needed, the user wipes the golf club head against the face piece, thereby removing debris from the golf club head. In the removable attached face piece embodiment, the face piece can be removed form the face plate, washed and reattached to the face plate for reuse.

V. BRIEF DESCRIPTION OF THE DRAWINGS

FIG. 6 is a top view of the device clipped on to the side of footwear.

FIG. 7 is a top view of the device clipped on to footwear illustrating a side view.

FIG. 8 depicts the device in use.

VI. DESCRIPTION OF THE PREFERRED EMBODIMENT

The description of the preferred embodiment and the appended drawings are directed to the inventive device being affixed to golfing footwear. It should be understood, however, that the device can also be attached to other articles of clothing, such as a belt, waist band or other articles of clothing, or equipment.

Figure 1:
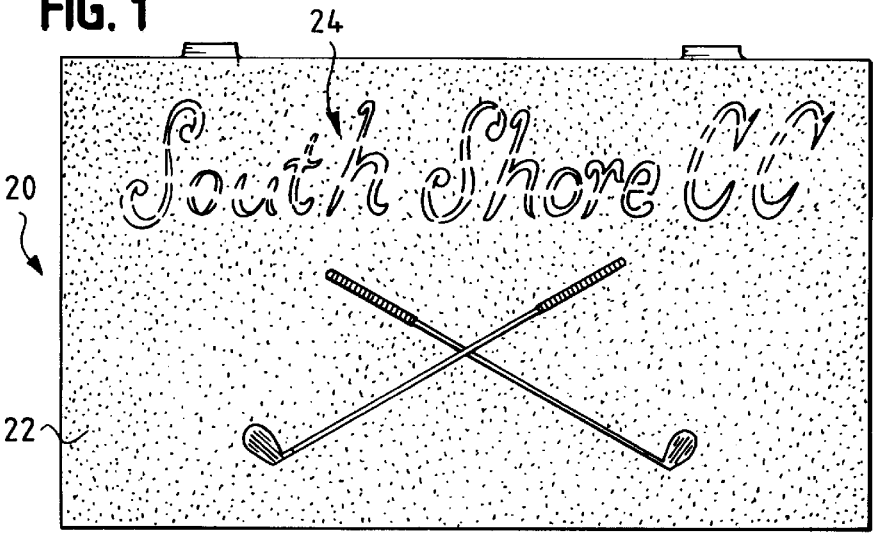
FIG. 1 depicts the front of the device.

Turning to FIG. 1, the front of device 20 is depicted illustrating removable face piece 22. Removable face piece 22 is preferably made of absorbable, semi-abrasive material, such as terry cloth or nylon. Alternatively, face plate 22 may be made of a semi-rigid or rigid material. Face piece 22 also serves as a display board for indicia 24. Indicia 24 can include words, phrases, and/or logos which have been imprinted, embossed, sewn or otherwise affixed to face piece 22.

Figure 2:
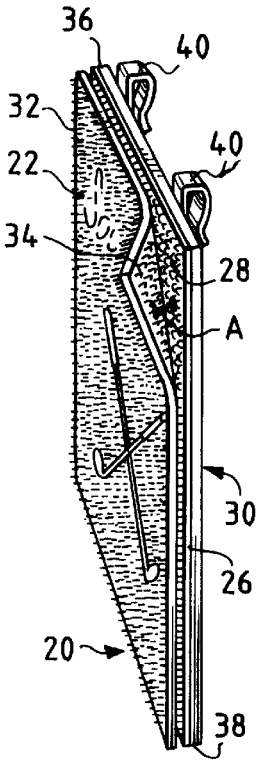
FIG. 2 depicts a side view of the device illustrating the face piece and attachment means.

Turning to FIG. 2, it can be seen that face piece 22 is removable from face plate 26. Face plate 26 has a front 28 and a back 30. Front 28 has a reusable, attachment means such as Velcro® affixed to it. Face piece 22 also has a front 32 and a back 34. Face piece back 34 has a complementary piece of reusable attachment means affixed to it. Face piece 22 is removably affixed to face plate front 28 at point A.

Alternatively, face piece 22 can be permanently affixed to face plate 26 by means of a permanent adhesive. This embodiment can be employed in a disposable version of the device.

In yet another embodiment, face piece 22 may be directly molded into face plate 26. For example, face piece 22 may be designed to look like artificial grass. Face piece 22 can, therefore, be either removably or permanently affixed to face plate 26 or made an integral part of face plate 26.

Face plate 26 has a top 36 and a bottom 38. Clips 49 are affixed to face plate 26 near top 36. Although FIG. 2 depicts clips 40 being attached to face plate 26 at the uppermost edge of top 36, clips 40 can be affixed at any point along back 30 of face plate 36. The inventor has found, however, that affixing clips 40 near top 36 of face plate 26 results in a more stable and easier to use device. Clips 40 can be molded into face plate 26 by any conventional means or, alternatively, can be added later. For cost considerations, it is desirable that clip 40 be molded of plastic affixed integrally with face plate 26. However, clips 40 may also be made of metal or other material, including plastic, and affixed to face plate 26 via any conventional attachment means, such as gluing, screwing, riveting, etc.

Likewise, it is not critical that face plate 26 be made of plastic, however, it is the preferred material from a cost basis. Other materials, such as aluminum or other forms of metal, can also be utilized. While these alternate materials increase the cost of production, they can also add to the strength of the overall device. Therefore, face plate material choice is not critical to the scope or spirit of the invention. Any rigid or semi-rigid material that can be shaped into a form adequate to provide an appropriate head cleaning surface is suitable.

Figure 4:
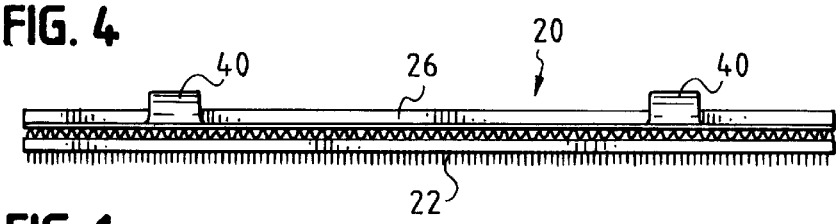
FIG. 4 is a top view of the device illustrating a flat embodiment.
Figure 5:
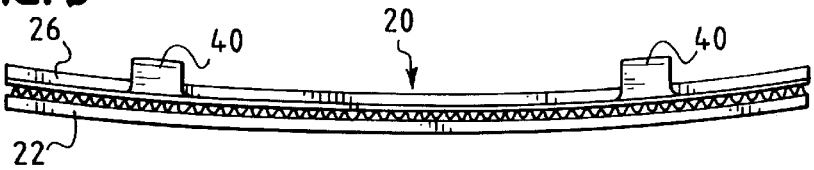
FIG. 5 is a top view of the device illustrating a curved embodiment.

Face plate 26 can be of any shape. As depicted in FIG. 1, face plate 26 is rectangular. Face plate 26 can also be of oval, circular, or other geometric shape. Again, the only limitations are that it provide sufficient surface area for golf club cleaning and does not interfere with the movement of a golfer. In FIGS. 4 and 5, it can be seen from a top view that face plate 26 may be flat (FIG. 4) or other shape, (as depicted in FIG. 5 concave) when viewed from the top. A flat surface is the most economical to produce; however, a concave shape may be more comfortable for the user.

Figure 3:
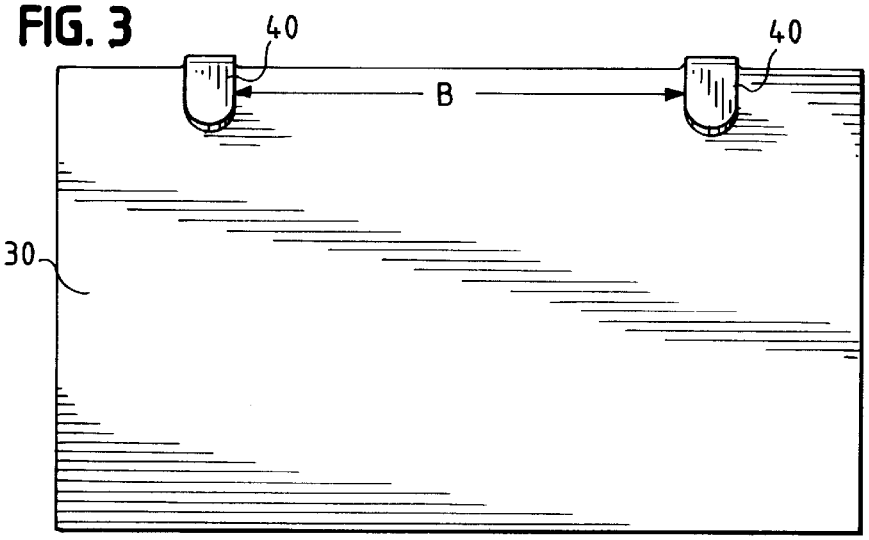
FIG. 3 depicts the back of the device illustrating the clips.

Turning to FIG. 3, clips 40 protrude from the back of face plate 26. The spacing B of clips 40 from one another should be of sufficient distance to provide stability to the device. The number of clips is not critical however. For instance, a single large clip may be utilized or multiple small clips or even a single clip which extends form one edge of face piece 26 to the opposite end of face piece 26 may be used. Moreover, a tension clip such as shown is not critical. The clips may be of any design, for example—spring clips.

Turning to FIG. 6, use of device 20 is depicted. In this instance, device 20 is attached to golf footwear 42. Clips 40 are removably secured over the top of golf footwear material 44 so that device 20 hangs in a downward direction as depicted in FIG. 7. When a golf club C needs cleaning, it is wiped across face piece 22 until sufficiently cleaned (FIG. 8). Alternatively, Device 20 may be hand held and used to clean golf club C. Face piece 22 can also be removed from face plate 26 and used for cleaning. For example, face piece 22 can be wrapped around a golf club shaft to clean the shaft.

When the removably affixed face piece embodiment is used, face piece 22 can be removed from face plate 26 when soiled, washed, and reattached to face plate 26.

As discussed above, the preferred embodiment is directed to use of the device affixed to golf footwear. However, the device may also be attached to clothing or other equipment. Additionally, the device can be removed from clothing, equipment, or golf footwear and be hand held while cleaning clubs. Therefore, the scope and spirit of the invention is to be limited only by the appended claims.

I claim:

1. A golf club cleaning apparatus comprising:

a face piece having material for cleaning golf clubs;

a face plate;

means for affixing the material to the face plate;

means for attaching the face plate to footwear, said means for attaching comprising at least one clip;

whereby the material is attached to the face plate, the face plate using the means for affixing the material to the face plate being removably affixed to footwear with the means for attaching.

2. The golf club cleaning apparatus of claim 1 wherein the material is terry cloth.

3. The golf club cleaning apparatus of claim 1 wherein the material is nylon.

4. The golf club cleaning apparatus of claim 1 wherein the face plate is plastic.

5. The golf club cleaning apparatus of claim 1 wherein the face plate is metal.

6. The golf club cleaning apparatus of claim 1 wherein the face piece is removably attached to the face plate.

7. The golf club cleaning apparatus of claim 1 wherein the face piece is permanently affixed to the face plate.

8. A golf club cleaning apparatus comprising a face piece made of a material suitable for cleaning golf club heads, the face piece being integral to a face plate, and means for affixing the face plate to footwear being affixed to the face plate's back side, said means for affixing comprising at least one clip.

9. The golf club cleaning apparatus of claim 8 wherein the face plate is made of a rigid material.

10. The golf club cleaning apparatus of claim 8 wherein the face plate is made of a semi-rigid material.

11. A golf club cleaning apparatus comprising a face piece made of a material suitable for cleaning golf clubs, the face piece having indicia being displayed on it, the face piece being removably affixed to a semirigid face plate, the face plate having a front side and a back side, and means for affixing the face plate to footwear being affixed to the face plate's back side.

12. The golf club cleaning apparatus of claim 11 wherein the face plate is rigid.

* * * * *